US006669315B2

(12) United States Patent
Heidmann et al.

(10) Patent No.: US 6,669,315 B2
(45) Date of Patent: Dec. 30, 2003

(54) LIFT METHOD FOR STORAGE BIN DOOR

(75) Inventors: Kurt R. Heidmann, Grand Rapids, MI (US); Thomas B. Eich, Palo Alto, CA (US)

(73) Assignee: Steelcase Development Corporation, Caledonia, MI (US)

( * ) Notice: Subject to any disclaimer, the term of this patent is extended or adjusted under 35 U.S.C. 154(b) by 0 days.

(21) Appl. No.: 10/357,931

(22) Filed: Feb. 4, 2003

(65) Prior Publication Data

US 2003/0117047 A1 Jun. 26, 2003

Related U.S. Application Data

(62) Division of application No. 09/723,997, filed on Nov. 28, 2000, now Pat. No. 6,536,860.

(51) Int. Cl.[7] ..... A47B 88/00
(52) U.S. Cl. ..... 312/352; 312/322
(58) Field of Search ..... 312/352, 319.1, 312/319.2, 319.4, 245, 322, 323, 325, 326, 327, 328, 329, 315; 49/40, 204, 206

(56) References Cited

U.S. PATENT DOCUMENTS

| | | | | |
|---|---|---|---|---|
| 180,605 A | | 8/1876 | Lee | 49/40 |
| 463,150 A | | 11/1891 | Graves | 312/319.4 X |
| 479,857 A | * | 8/1892 | Tettelbach | 312/323 X |
| 1,447,060 A | | 2/1923 | Boughton | 49/206 X |
| 2,328,204 A | | 8/1943 | Ferris | |
| 2,549,140 A | | 4/1951 | Svendesen | |
| 3,001,225 A | | 9/1961 | Squire | |
| 3,693,474 A | | 9/1972 | Trick | |
| 3,906,587 A | | 9/1975 | Little | |
| 4,831,966 A | | 5/1989 | Tutelian | |
| 5,079,797 A | | 1/1992 | Ohshima et al. | 16/DIG. 9 |
| 5,172,969 A | | 12/1992 | Reuter et al. | |
| 5,399,010 A | | 3/1995 | McClung et al. | 312/334.1 |
| 5,409,308 A | | 4/1995 | Reuter et al. | |
| 5,524,979 A | | 6/1996 | Carson et al. | 312/319.2 |
| 5,645,333 A | | 7/1997 | Sakurai | 312/322 |
| 6,227,635 B1 | | 5/2001 | Teppo et al. | 312/328 |
| 6,296,337 B1 | | 10/2001 | Kawanabe | 312/319.2 |

FOREIGN PATENT DOCUMENTS

| | | | | |
|---|---|---|---|---|
| CH | 430783 | | 8/1967 | 49/40 |
| FR | 1121697 | | 8/1956 | 312/319.2 |
| JP | 40-6090827 | * | 4/1994 | 312/352 |

* cited by examiner

*Primary Examiner*—James O. Hansen
(74) *Attorney, Agent, or Firm*—Price Heneveld Cooper Dewitt & Litton

(57) ABSTRACT

A method for opening a door on a storage bin is provided, where the storage bin includes a door pivoted to the storage bin for movement between open and closed positions, and a biasing device operably connected to the storage bin and the door for biasing the door as the door nears the open and closed positions. The biasing device includes a spring and a T-shaped shifting anchor connected to the spring that translates and changes a torque arm of a linear spring as the door is moved so that the spring creates a force sufficient to close the door during a last portion of door closure movement and so that the spring creates a force sufficient to open the door during a last portion of door opening movement.

14 Claims, 2 Drawing Sheets

LIFT METHOD FOR STORAGE BIN DOOR

CROSS REFERENCE TO RELATED APPLICATION

This application is a divisional of commonly assigned, co-pending, co-invented application Ser. No. 09/723,997, filed Nov. 28, 2000, entitled LIFT MECHANISM FOR STORAGE BIN DOOR now U.S. Pat. No. 6,536,860.

BACKGROUND OF THE INVENTION

The present invention relates to door mechanisms on storage units, such as for partition-mounted binder bins. However, it should be understood that a scope of the present invention is not limited to only partition-mounted storage units.

It is desirable to counterbalance a weight of doors on binder bins so that the doors do not swing closed with a hard action. Further, it is desirable to bias a door into a fully open or fully closed position for aesthetic and ergonomic reasons and also so that the door does not accidentally fall from the open position toward the closed position. However, such biasing devices are generally not available or are undesirably complex. One reason is because an operative weight of the door changes as the door moves between its opened and closed positions, such that it is difficult for a single mechanism to satisfy the force requirements near the open position and at the same time near the closed position. For example, in a door pivoted to a sidewall of a binder bin, the operative weight of the door is at its maximum when the door is near the closed position, because the center of gravity of the door is farthest forward of the pivot point. Contrastingly, when the door is near its opened position, the operative weight is relatively low because the center of gravity of the door is closest to the pivot point.

Accordingly, an apparatus is desired having the aforementioned advantages and that solves the aforementioned problems.

SUMMARY OF THE PRESENT INVENTION

The present invention includes a method of biasing a cover member of a furniture unit between open and closed positions. The method includes steps of attaching a biasing element to the cover member at a first attachment point, and attaching the biasing element to an anchor member at a second attachment point, the anchor member being operably coupled to the furniture unit. The method further includes translatingly moving one of the first and second attachment points from a first position to a second position as the cover member is moved from an open position to a closed position, and still further includes translatingly moving the one attachment point from the second position to the first position as the cover member is moved from the closed position to the open position. The two steps of translatingly moving the one attachment point occur relatively sudden and have the effect of changing an effective length of a torque arm defined by the biasing element. The biasing element biases the cover member with a first biasing force when the one attachment point is in the second position to positively close the cover member, and further the biasing element biases the cover member with a second biasing force when the one attachment point is in the first position to positively open the cover member.

In another aspect of the present invention, a method includes steps of providing a biasing element operably attached between a binder bin and a cover member, with the biasing element providing a continuous counter-balancing force to the cover member both when opening and closing the cover member on a front of the binder bin, the biasing element including an anchorage member. The method further includes opening the cover member, with the biasing element providing the counter-balancing force, and suddenly shifting the anchor member as the cover member reaches a near-open position so that the counter-balancing force changes substantially to more positively move the cover member from the near-open position to a full-open position. The method also includes closing the cover member, with the biasing element providing the counter-balancing force, and suddenly shifting the anchor member as the cover member reaches a near-closed position so that the balancing force changes substantially to more positively move the cover member from the near-closed position to a full-closed position.

These and other features, objects, and advantages of the present invention will become apparent to a person of ordinary skill upon reading the following description and claims together with reference to the accompanying drawings.

DETAILED DESCRIPTION OF THE PRESENT EMBODIMENT

Figure 1:
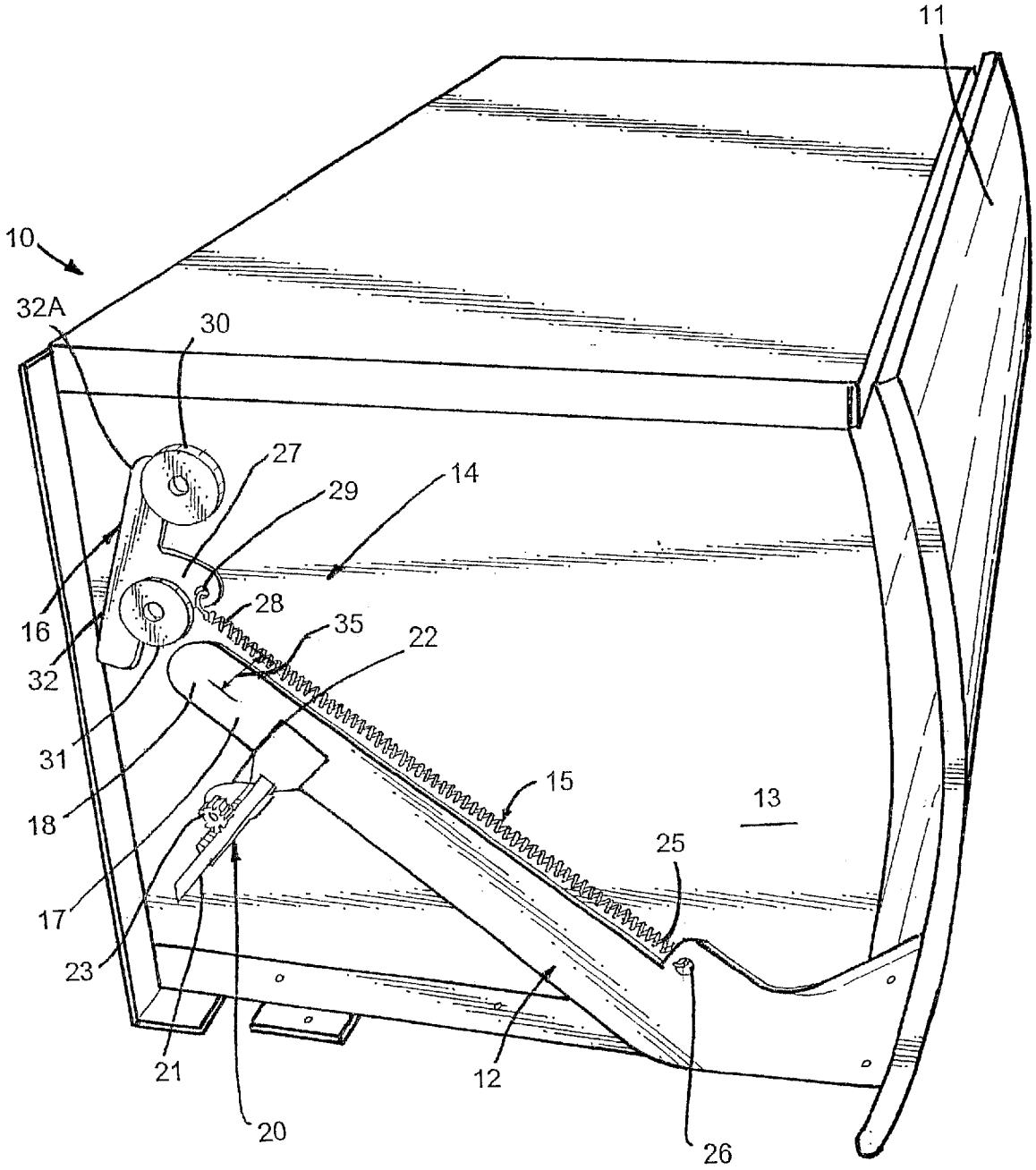
FIG. 1 is a perspective view of a binder bin embodying the present invention, including a door in a closed position.

A storage bin 10 (FIG. 1) includes a door 11 (sometimes called a "cover member" herein) having a pair of door-supporting arms 12 pivoted to a sidewall 13 of the storage bin for movement between an open position (FIG. 1) and a closed position (FIG. 2) for closing a front opening of the bin 10. A biasing device 14 is operably connected to at least one of the door-supporting arms 12 for biasing the door 11 as the door 11 nears its open and closed positions. The biasing device 14 includes a spring 15 and a T-shaped shifting anchor 16 connected to the spring 15 that translates and changes a torque arm of a linear spring 15 as the door 11 is moved so that the spring 15, in combination with a weight of the door 11, creates a force sufficient to safely close the door 11 during a last portion of door closure movement and so that the spring 15 creates a force sufficient to safely open the door 11 during a last portion of door opening movement.

The illustrated door-supporting arm 12 includes a first end 17 pivoted at a main pivot 18 to the sidewall 13, and includes a second end fixed to a bottom portion of the door 11. It is contemplated that different door-supporting arrangements can be made and still be used with the present inventive concepts.

A dampening device, such as the illustrated silicone pot dampener 20, is attached to the sidewall 13. The dampener 20 includes a rack 21 pivoted to the door-supporting arm 12, and a pot 22 of viscous material. A pinion gear 23 engages the rack 21 and causes a disk to rotate within the pot 22 as the door-supporting arm 12 moves while opening and closing the door 11. It is contemplated that a variety of different dampening devices can be used and still be within a scope of the present inventive concepts.

The spring 15 is extends parallel the door-supporting arm 12, and includes a first end 25 hooked into a hole 26 to create a pivotable connection. The anchor 16 of the biasing device 14 is T-shaped, and includes a stem 27 that extends parallel the spring 15, with a second end 28 of the spring being hooked into a hole 29 in an end of the stem 27. A pair of wheel bearings 30 and 31 engage arms 32 and 32A of the T-shaped anchor 16, and support the anchor 16 for linear movement on the bin sidewall 13. It is noted that a variety of different bearings and engaging members can be used to linearly support a translatable anchor. For example, slots and sliding tabs can be used, linear bearings and telescoping rods can be used, grooves and followers can be used, guide rods and riding pads can be used. The anchor 16 is movable between a first position (FIG. 1) where the stem 27 abuts the bottom wheel bearing 30, and a second position (FIG. 2) where the stem 27 abuts the top wheel bearing 31.

In the first position (FIG. 1), the position of the hole 29 is relatively close to the main pivot 18. This position is calculated to create a predetermined small torque arm 35 that operates through the anchor 16, so that the linear force generated by the spring 15 causes a torsional force that, in combination with a weight of the door 11 and door-supporting arm 12, causes the door 11 to close with a positive but safe action when the door 11 is within the lower half of its path of movement.

In the second position (FIG. 2), the position of the hole 29 is spaced somewhat from the main pivot 18. This position is calculated to create a predetermined larger torque arm 36 that operates through the anchor 16, so that the linear force generated by the spring 15 causes a torsional force that, despite a weight of the door 11 and door-supporting arm 12, causes the door 11 to open with a positive but safe action when the door 11 is within the upper half of its path of movement.

Figure 2:
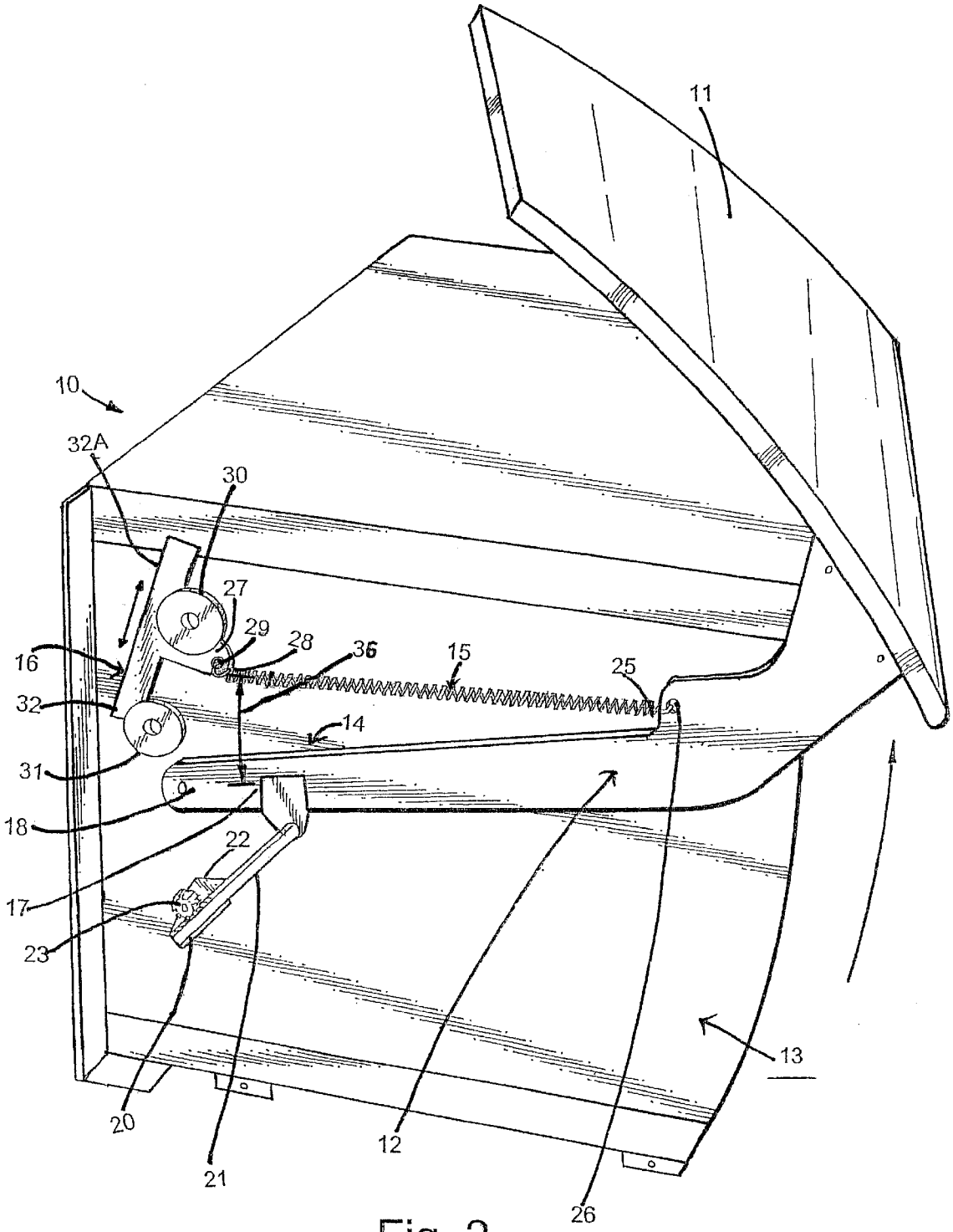
FIG. 2 is a perspective view similar to FIG. 1, but with the door in an open position.

Notably, when the door 11 is in the lowered position shown in FIG. 1, the spring 15 moves the anchor 16 to the lowered second position shown in FIG. 1. As the door 11 is moved upwardly through the initial half of door movement, the anchor 16 does not shift. As the door 11 is further moved upwardly into the upper portion of its path of movement, the anchor 16 begins to receive an increasing lateral force that tends to bias the anchor 16 toward its "up" position, but it still does not shift. Depending on the frictional and other operating characteristics of the biasing device 14, the anchor 16 has at least some hysteresis effect where the anchor 16 does not shift until past a mid-point of movement of the door movement. Further, the anchor 16 can have grease or other material that will slow its movement to prevent accelerated harsh movement of the anchor 16 as it moves from one position to another. In the upper portion of the door movement, the anchor 16 shifts (or has shifted) to its "up" position (FIG. 2), where the torsional force is calculated to cause the door 11 to move positively but safely to an opened position.

When the door 11 is closed, the above effects are reversed. Without repeating all details, the anchor 16 remains in an "up" position (FIG. 2) during a first half of the downward movement of the door 11. At some time during the middle or intermediate position of the door 11, the anchor 16 shifts to its lower position. During the lower third of door movement, the anchor 16 along with a weight of the door 11 biases the door 11 to a closed position. The speed and timing of the shifting of the anchor 16 depends on the frictional characteristics of the biasing device 14, and upon the speed at which the door 11 is opened or closed.

The method includes steps of attaching the biasing element 15 to the cover member 11 at a first attachment point, attaching the biasing element 15 to an anchorage member 16 at a second attachment point, with the anchorage member 16 being operably translatably coupled to the furniture unit 10. The method further includes linearly translatingly moving the anchorage member 16 from a first position to a second position as the cover member 11 is moved from an open position to a closed position and translatingly moving the one attachment point from the second position to the first position as the cover member 11 is moved from the closed position to the open position. The biasing element 15 biases the cover member 11 with a first biasing force when the one attachment point is in the second position to positively but safely close the cover member 11, and the biasing element 15 biases the cover member 11 with a second biasing force when the one attachment point is in the first position to positively but safely open the cover member 11.

It is noted that the present door arrangement will open or close when released, regardless of the door position. In other words, there is no "dead" zone for the door, when the bearings 30 and 31 are low friction.

In the foregoing description, it will be readily appreciated by persons skilled in the art that modifications may be made to the invention without departing from the concepts disclosed herein. For example, it is contemplated that the transition point or "switch-over" point can be changed by design to occur anywhere along the door opening path or door closing path to meet specific user desires or requirements. Such modifications are to be considered as included in the following claims, unless these claims, by their language, expressly state otherwise.

The invention claimed is:

1. A method of biasing a cover member of a furniture unit; said method comprising steps of:

attaching a biasing element to the cover member at a first attachment point;

attaching said biasing element to an anchorage member at a second attachment point, the anchorage member being operably coupled to the furniture unit; and translatingly moving one of said first and second attachment points from a first position to a second position as said cover member is moved from an open position to a closed position and translatingly moving said one of said first and second attachment points from said second position to said first position as said cover member is moved from the closed position to the open position, the step of translatingly moving from the first position to the second position and also from the second position to the first position being relatively sudden and having the effect of changing an effective length of a torque arm defined by the biasing element, said biasing element biasing said cover member with a first biasing force when said one attachment point is in the second position to positively close the cover member, and said biasing element biasing said cover member with a second biasing force when said one attachment point is in the first position to positively open the cover member, wherein said anchorage member is a T-shaped member, and wherein the step of attaching the biasing element to the anchorage member includes attaching the biasing element to a stem of the T-shaped member.

2. The method of claim 1, wherein the T-shaped member has two arms that extend from the stem and that align with a direction of movement as the biasing element is shifted.

3. A method of biasing a cover member of a furniture unit; said method comprising steps of:

attaching a biasing element to the cover member at a first attachment point;

attaching said biasing element to an anchorage member at a second attachment point, the anchorage member being operably coupled to the furniture unit; and translatingly moving one of said first and second attachment points from a first position to a second position as said cover member is moved from an open position to a closed position and translatingly moving said one of said first and second attachment points from said second position to said first position as said cover member is moved from the closed position to the open position, the step of translatingly moving from the first position to the second position and also from the second position to the first position being relatively sudden and having the effect of changing an effective length of a torque arm defined by the biasing element, said biasing element biasing said cover member with a first biasing force when said one attachment point is in the second position to positively close the cover member, and said biasing element baising said cover member with a second biasing force when said one attachment point is in the first position to positively open the cover member, wherein moving the cover member between the open position and the closed position changes an angle at which the biasing element exerts a force on said anchorage member, whereby as the cover member is moved, said anchorage member is translated relative to said furniture unit and said second attachment point is moved between said first position and said second position.

4. The method of claim 3, wherein the biasing member defines a torque arm, and the step of translatingly moving one of said first and second attachment points results in a length change of the torque arm.

5. The method of claim 3, wherein the first and second biasing forces are different torques.

6. A method of biasing a cover member of a furniture unit; said method comprising steps of:

attaching a biasing element to the cover member at a first attachment point;

attaching said biasing element to an anchorage member at a second attachment point, the anchorage member being operably coupled to the furniture unit; and translatingly moving one of said first and second attachment points from a first position to a second position as said cover member is moved from an open position to a closed position and translatingly moving said one of said first and second attachment points from said second position to said first position as said cover member is moved from the closed position to the open position, the step of translatingly moving from the first position to the second position and also from the second position to the first position being relatively sudden and having the effect of changing an effective length of a torque arm defined by the biasing element, said biasing element biasing said cover member with a first biasing force when said one attachment point is in the second position to positively close the cover member, and said biasing element biasing said cover member with a second biasing force when said one attachment point is in the first position to positively open the cover member, wherein said cover member is pivoted through an angular range of motion between said closed position and said open position and said second attachment point is disposed in said first position when said cover member is disposed within about one third of said angular range of motion nearest said open position and said second attachment point is disposed in said second position when said cover member is disposed within about one third of said angular range of motion nearest said closed position.

7. The method defined in claim 6, wherein the anchorage member shifts during a middle portion of a path of movement of the cover member.

8. A method of biasing a cover member of a furniture unit; said method comprising steps of:

attaching a biasing element to the cover member at a first attachment point;

attaching said biasing element to an anchorage member at a second attachment point, the anchorage member being operably coupled to the furniture unit; and translatingly moving one of said first and second attachment points from a first position to a second position as said cover member is moved from an open position to a closed position and translatingly moving said one of said first and second attachment points from said second position to said first position as said cover member is moved from the closed position to the open position, the step of translatingly moving from the first position to the second position and also from the second position to the first position being relatively sudden and having the effect of changing an effective length of a torque arm defined by the biasing element, said biasing element biasing said cover member with a first biasing force when said one attachment point is in the second position to positively close the cover member, and said biasing element biasing said cover member with a second biasing force when said one attachment point is in the first position to positively open the cover member, wherein the biasing member includes a linearly extensible spring, and the anchorage member is configured to move in a direction generally perpendicular relative to a longitudinal direction defined by the linearly extensible spring.

9. A method comprising steps of:

providing a biasing element operably attached between a binder bin and a cover member, with the biasing element providing a continuous counter-balancing force to the cover member both when opening and closing the cover member on a front of the binder bin, the biasing element including an anchorage member;

opening the cover member, with the biasing element providing the counter-balancing force;

suddenly shifting the anchorage member as the cover member reaches a near-open position so that the counter-balancing force changes substantially to more positively move the cover member from the near-open position to a full-open position;

closing the cover member, with the biasing element providing the counter-balancing force; and suddenly shifting the anchorage member as the cover member reaches a near-closed position so that the balancing force changes substantially to more positively move the cover member from the near-closed position to a full-closed position.

10. The method of claim 9, wherein the anchorage member is a T-shaped member.

11. The method of claim 10, including operably attaching the anchorage member to the binder bin.

12. The method of claim 9, wherein the biasing element defines a torque arm, and wherein the steps of suddenly shifting both result in a length change of the torque arm.

13. The method of claim 9, wherein the two steps of suddenly shifting occur at different points when opening and closing the cover member.

14. The method of claim 9, wherein the biasing element includes a linearly extensible spring, and the anchorage member is configured to move in a direction generally perpendicular relative to the longitudinal direction defined by the extensible spring.

* * * * *